US011227755B2

(12) United States Patent
Gonin et al.

(10) Patent No.: US 11,227,755 B2
(45) Date of Patent: Jan. 18, 2022

(54) AUTOSAMPLER

(71) Applicant: TOFWERK AG, Thun (CH)

(72) Inventors: Marc Gonin, Thun (CH); Felipe Lopez-Hilfiker, Bern (CH); Manuel Hutterli, Bern (CH); Matthias Erb, Boltigen (CH); Marc Pfander, Zürich (CH)

(73) Assignee: TOFWERK AG, Thun (CH)

( * ) Notice: Subject to any disclaimer, the term of this patent is extended or adjusted under 35 U.S.C. 154(b) by 0 days.

(21) Appl. No.: 16/962,904

(22) PCT Filed: Feb. 1, 2019

(86) PCT No.: PCT/EP2019/052533
§ 371 (c)(1),
(2) Date: Jul. 17, 2020

(87) PCT Pub. No.: WO2019/149903
PCT Pub. Date: Aug. 8, 2019

(65) Prior Publication Data

US 2021/0066058 A1 Mar. 4, 2021

(30) Foreign Application Priority Data

Feb. 2, 2018 (EP) ..... 18155008

(51) Int. Cl.
*H01J 49/04* (2006.01)

(52) U.S. Cl.
CPC ..... *H01J 49/0413* (2013.01); *H01J 49/0422* (2013.01)

(58) Field of Classification Search
CPC ..... H01J 49/0413; H01J 49/0422; H01J 49/0431; G01N 35/02; G01N 1/10;
(Continued)

(56) References Cited

U.S. PATENT DOCUMENTS 6,872,362 B2 * 3/2005 Schmidt ..... B01F 13/0818 422/561
7,214,320 B1 * 5/2007 Gregori ..... B01L 3/502753 210/143
(Continued)

FOREIGN PATENT DOCUMENTS

EP 2572188 A1 3/2013
WO WO 00/62039 A1 10/2000
(Continued)

*Primary Examiner* — Wyatt A Stoffa
(74) *Attorney, Agent, or Firm* — Birch, Stewart, Kolasch & Birch, LLP

(57) ABSTRACT

An autosampler for obtaining mass spectra from a plurality of fluid samples, in particular gaseous samples including a plurality of containers including sample sources providing the samples, wherein each one of the containers provides a docking port for being connected with a connector for enabling access to an inside of the respective container via the connector in order to obtain the respective sample from the respective container via said connector. The autosampler further includes an ionisation source for ionising at least a part of the samples, and a mass analyser for obtaining the mass spectra from the ions. The ionisation source is moveable within the autosampler sequentially to each of the containers for connecting the connector to the docking port of the respective container for collecting the sample from the respective container for ionising at least a part of the sample and obtaining the mass spectra from the ions.

18 Claims, 2 Drawing Sheets

(58) Field of Classification Search
CPC ..... G01N 1/22; G01N 35/10; G01N 35/1081; G01N 2001/1056; G01N 2001/2285; G01N 2001/2291
See application file for complete search history.

(56) References Cited

U.S. PATENT DOCUMENTS

| | | | | |
|---|---|---|---|---|
| 9,146,180 | B2 * | 9/2015 | Van Berkel | G01Q 30/02 |
| 11,011,365 | B2 * | 5/2021 | Wen | H01J 49/426 |
| 2002/0168778 | A1 * | 11/2002 | Andrien, Jr. | H01J 49/0445 436/173 |
| 2004/0021068 | A1 * | 2/2004 | Staats | B01L 9/527 250/288 |
| 2004/0021071 | A1 * | 2/2004 | Mordekhay | H01J 49/0413 250/288 |
| 2010/0224013 | A1 * | 9/2010 | Berkel | H01J 49/0459 73/863.81 |
| 2011/0133077 | A1 * | 6/2011 | Henion | G01N 1/405 250/288 |
| 2011/0220787 | A1 * | 9/2011 | Shiea | H01J 49/165 250/288 |
| 2012/0053065 | A1 * | 3/2012 | Van Berkel | H01J 49/0431 506/7 |
| 2012/0153143 | A1 * | 6/2012 | Kennedy | H01J 49/165 250/282 |
| 2014/0048697 | A1 * | 2/2014 | Cooks | H01J 49/0036 250/281 |
| 2014/0183351 | A1 * | 7/2014 | Cooks | H01J 49/0431 250/282 |
| 2014/0238155 | A1 * | 8/2014 | Van Berkel | G01N 1/38 73/864 |
| 2014/0283627 | A1 | 9/2014 | Hattingh et al. | |
| 2014/0353488 | A1 * | 12/2014 | Takats | G01N 27/622 250/282 |
| 2015/0308986 | A1 * | 10/2015 | Ito | G01N 30/24 435/29 |
| 2016/0104610 | A1 * | 4/2016 | Hofstadler | H01J 49/0422 250/423 R |
| 2018/0033600 | A1 * | 2/2018 | Manicke | G01N 30/95 |
| 2018/0038837 | A1 * | 2/2018 | Ito | G01N 35/08 |
| 2018/0238776 | A1 * | 8/2018 | Karancsi | A61B 10/00 |
| 2019/0198309 | A1 * | 6/2019 | Wen | H01J 49/062 |
| 2020/0015717 | A1 * | 1/2020 | Taghioskoui | A61B 5/4842 |
| 2020/0279728 | A1 * | 9/2020 | Eberlin | H01J 49/0031 |
| 2020/0381238 | A1 * | 12/2020 | Cooks | H01J 49/0413 |

FOREIGN PATENT DOCUMENTS

| | | | |
|---|---|---|---|
| WO | WO 2011/145923 | A1 | 11/2011 |
| WO | WO 2013/076496 | A1 | 5/2013 |

* cited by examiner

AUTOSAMPLER

TECHNICAL FIELD

The invention relates to an autosampler for obtaining mass spectra from a plurality of fluid samples, in particular gaseous samples. This autosampler comprises a plurality of containers comprising sample sources providing the samples, wherein each one of the containers provides a docking port for being connected with a connector for enabling access to an inside of the respective container via the connector when the connector is connected to the respective docking port in order to obtain the respective sample from the respective container via the connector, wherein the connector is connectable to and detachable from each docking port. Furthermore, the autosampler comprises an ionisation source for ionising at least a part of the samples to ions, wherein the ionisation source is fluidly coupled to the connector for receiving the samples from the containers via the connector. Additionally, the autosampler comprises a mass analyser for obtaining the mass spectra from the ions, the mass analyser being fluidly coupled to the ionisation source for receiving the ions from the ionisation source for obtaining the mass spectra from the ions.

BACKGROUND ART

Autosamplers are devices which automatically collect and analyse samples. Autosamplers for obtaining mass spectra from a plurality of fluid samples pertaining to the technical field initially mentioned are known. They commonly have the disadvantage that during the transfer of the samples from the containers to the ionisation source and subsequently to the mass analyser, an intermixture of the different samples occurs, contaminating the obtained mass spectra which downgrades their significance.

SUMMARY OF THE INVENTION

It is the object of the invention to create an autosampler pertaining to the technical field initially mentioned, that enables obtaining more accurate mass spectra of a plurality of fluid samples. Furthermore, it is the object of the invention to create a method for operating an autosampler according to the invention that enables obtaining more accurate mass spectra of a plurality of fluid samples.

The solution of the invention is specified by the features of claim 1. According to the invention, the ionisation source is moveable with the connector within the autosampler sequentially to each one of the plurality of the containers for connecting the connector to the docking port of the respective container for collecting the sample from the respective container for ionising at least a part of the sample to ions and obtaining the mass spectra from the ions.

According to the invention, the samples are fluid samples. Thus, the samples can be liquid samples or gaseous samples. These samples originate from sample sources in the containers. Thereby preferably each one of the containers comprises one of the sample sources. The sample sources may for example each be a liquid. In this case, if the samples are liquid samples, then each sample may be a part of the sample source. Or, if the sample sources each are a liquid, the samples may be vaporised liquid and thus gaseous samples. When the sample sources are liquid or aqueous sample sources, headspace sampling may for example be employed for obtaining the samples.

Instead of a liquid, the sample sources can each be a gas, too. In other variants, the sample sources can be microorganisms, plants, or objects like wood, fabrics, drugs or pills or any solid stored in the containers. In this case, the samples may for example be gas which is degassed by the respective sample source in the respective container.

The containers may for example be jars, boxes, vials or any other container capable of containing a sample source. For example, the containers may each be a chemical reactor or any other type of reactor or a material emission climate chamber.

According to the invention, each one of the containers provides a docking port for being connected with a connector for enabling access to an inside of the respective container via the connector when the connector is connected to the respective docking port in order to obtain the respective sample from the respective container via the connector. Thereby, the docking port may be a port located at the respective container or may be a port on a tube fluidly coupling the port to the inside of the respective container.

According to the invention, the ionisation source is for ionising at least a part of said samples to ions. Advantageously, the ionisation source is for ionising at least a part of each one of the samples to ions. Alternatively, the ionisation source is for ionising at least a part of at least one of the samples to ions.

The method according to the invention for obtaining mass spectra from a plurality of fluid samples with an autosampler according to the invention comprises keeping sample sources providing the samples in a plurality of containers, wherein each one of the containers provides a docking port for being connected with a connector for enabling access to an inside of the respective container via the connector when the connector is connected to the respective docking port in order to obtain the respective sample from the respective container via the connector, wherein the connector is connectable to and detachable from each docking port. The method according to the invention furthermore comprises sequentially sampling the containers by:

a) moving an ionisation source and the connector within the autosampler to each desired one of the plurality of said containers, connecting the connector to the docking port of the respective container,
b) collecting the respective sample from the respective container,
c) transferring the respective sample via the connector to the ionisation source,
d) ionising at least a part of the respective sample to ions,
e) transferring the ions to a mass analyser and
f) obtaining the mass spectra from the ions.

Thereby, after the respective sample is collected from the respective container, the connector is detached from the docking port of the respective container. Thereby, it is irrelevant whether the connector is detached from the respective container before, during or after the mass spectra of the ions of the respective sample are obtained, as long as the respective sample is collected from the respective container when the connector is detached from the docking port of the respective container.

Advantageously, each time one of the containers is sampled, the respective sample is transferred during a time from 1 s to 60 s from the respective container to the ionisation source. Alternatively however, each time one of the connector is sampled, the respective sample can be transferred during a time shorter than 1 s or during a time longer than 60 s, too. For example, each time one of the containers is sampled, the respective sample is transferred during a time of 30 minutes or even more.

Advantageously, detaching the connector from the docking port of one of the containers, moving the ionisation source and the connector within the autosampler to the next one of the containers and connecting the connector to this next one of the containers takes a time from 1 s to 30 seconds. Alternatively however, this may take a shorter or a longer time.

Advantageously, mass spectra are obtained repeatedly when one of the containers is sampled. Preferably, per sampling of one container one or more mass spectrum is obtained. Preferably, up to $10^6$ or more mass spectra are obtained per sampling of one container. Preferably, mass spectra are obtained repeatedly as well when none of the containers is sampled. This has the advantage that any leftovers in the system from samples originating from containers previously sampled can be identified such that contaminations in mass spectra obtained from containers which are later sampled can be identified. In a variant however, mass spectra can be obtained repeatedly only when one of the containers is sampled.

Alternatively however, for each container being sampled only one mass spectrum is obtained.

Both the autosampler and the method according to the invention have the advantage that more accurate mass spectra of the samples can be obtained. One reason for this advantage is that due to the moving ionisation source, the sample sources are not required to be moved. Thus, the sample sources can be kept undisturbed which reduces interference factors which could distort the samples. At the same time, due to the moving ionisation source, a length of the sample path along which the samples are passed when being transferred from the respective container to the ionisation source can be reduced. Thus, an absolute number of remains of samples along the sample path is reduced due to the reduced length of the sample path, leading to less intermixtures of different samples as the samples are passed from the containers to the ionisation source.

Advantageously, the connector can be connected to one of the docking ports at a time only. Alternatively however, the connector can maximally be connected to two or three or even more docking ports at a time. For example, the connector can be constructed to be connectable to 25 docking ports at a time. In this exemplary case, a tray of 5×5 containers can be sampled at a time.

Advantageously, the ionisation source is moveable together with the connector within the autosampler to each one of the plurality of the containers for collecting the samples for connecting the connector to the docking port of the respective container for collecting the sample from the respective container for ionising at least a part of the sample to ions and obtaining the mass spectra from the ions. Thus, the ionisation source and the connector are preferably moveable at a fixed distance from each other within the autosampler when the ionisation source is moved from one container to another container for collecting the samples. In this case, the connector is preferably arranged at a fixed position with respect to the ionisation source. In an alternative however, the connector is moveable with respect to the ionisation source. Thus, for example, the ionisation source and the connector can be moveable at a fixed distance from each other within the autosampler when the ionisation source is moved from one container to another container for collecting the samples. Then, once the ionisation source is positioned correctly with respect to the respective container, the connector is moveable relative to the ionisation source for getting connected to the docking port of the respective container. In a variant however, the connector may be moveable relative to the ionisation source already during movement of the ionisation source with respect to the containers. In this case however, the connector and the ionisation source both move with respect to the containers when the ionisation source is moved with the connector from one container to another container for collecting the samples.

Advantageously, the autosampler comprises a driving unit for actuating movement of the ionisation source with the connector within the autosampler sequentially to each one of the plurality of the containers for connecting the connector to the docking port of the respective container for collecting the sample from the respective container for ionising at least a part of the sample to ions and obtaining the mass spectra from said ions. Thereby, the driving unit can comprise an electric motor, a pneumatic system or the like for actuating the movement of the ionisation source with the connector.

Preferably, the ionisation source is a chemical ionisation source. In a preferred variant, the ionisation source is a proton transfer reaction (PTR) ionisation source. In another preferred variant, the ionisation source is a charge transfer ionisation source. Alternatively, the ionisation source may be a different type of ionisation source. In this case for example, the ionisation source is an electrospray ionisation source, corona discharge ionisation source, an x-ray ionisation source, a plasma ionisation source, radioactive ionisation source. An electrospray ionisation source is particular advantageous in case the samples are liquid samples because an electrospray ionisation source readily generates ions from a liquid.

Preferably, the mass analyser is a time-of-flight mass analyser. Alternatively however, the mass analyser can be a different type of mass analyser like for example a quadrupole mass analyser.

Preferably, the mass analyser is moveable together with the ionisation source within the autosampler sequentially to each one of the plurality of the containers for connecting the connector to the docking port of the respective container for collecting the samples from the respective container for ionising at least a part of the samples to ions and for obtaining the mass spectra from the ions.

This has the advantage that a length of a path along which the ions are to be transferred from the ionisation source to the mass analyser can be kept short such that loss of ions is reduced. Consequently, this has the advantage that the efficiency of the mass analyser can be increased because more ions can be mass analysed per sample.

In case the mass analyser is moveable together with the ionisation source within the autosampler sequentially to each one of the plurality of the containers for connecting the connector to the docking port of the respective container for collecting the samples from the respective container for ionising at least a part of the samples to ions and for obtaining the mass spectra from the ions, the autosampler advantageously comprises a driving unit for actuating movement of the mass analyser together with the ionisation source within the autosampler sequentially to each one of the plurality of the containers for connecting the connector to the docking port of the respective container for collecting the sample from the respective container for ionising at least a part of the sample to ions and obtaining the mass spectra from the ions. This driving unit can be the same driving unit as or a different driving unit than the driving unit for actuating the movement of the ionisation source with the connector within the autosampler sequentially to each one of the plurality of the containers for connecting the connector to the docking port of the respective container for collecting the sample from the respective container for ionising at least a part of the sample to ions and obtaining the mass spectra from the ions.

In an advantageous variant, the mass analyser is moveable at a fixed distance from the ionisation source within the autosampler sequentially to each one of the plurality of the containers for connecting the connector to the docking port of the respective container for collecting the sample from the respective container for ionising at least a part of the sample to ions and obtaining the mass spectra from the ions. More advantageously, the mass analyser is moveable at a fixed position with respect to the ionisation source together with the ionisation source within the autosampler sequentially to each one of the plurality of the containers for connecting the connector to the docking port of the respective container for collecting the sample from the respective container for ionising at least a part of the sample to ions and obtaining the mass spectra from the ions. This has the advantage that the autosampler can be constructed simpler because the ionisation source and the mass analyser can be constructed in a single unit and because there is no complex construction required for transferring the ions from the ionisation source to the mass analyser.

In another variant however, the mass analyser is moveable with the ionisation source at a varying distance from the ionisation source within the autosampler sequentially to each one of the plurality of the containers for connecting the connector to the docking port of the respective container for collecting the sample from the respective container for ionising at least a part of the sample to ions and obtaining the mass spectra from the ions.

Alternatively, the mass analyser is not moveable with the ionisation source within the autosampler sequentially to each one of the plurality of the containers for connecting the connector to the docking port of the respective container for collecting the sample from the respective container for ionising at least a part of the sample to ions and obtaining the mass spectra from the ions. In this case, the mass analyser can for example be arranged at a fixed position within the autosampler.

Advantageously, the autosampler comprises an ion mobility spectrometer. In this case, the ion mobility spectrometer is preferably arranged to receive the ions from the ionisation source and preferably provides the ions to the mass analyser. Thereby, the mass analyser may be incorporated into the ion mobility spectrometer. Thus, in an example where the autosampler comprises an ion mobility spectrometer, the autosampler comprises a drifting region for separating ions according to their drifting time, wherein the ions are insertable into the drifting region in a pulsed manner at a first end of the drifting region, wherein the mass analyser is arranged at a second end of the drifting region for receiving the ions having passed the drifting region and for determining a time the ions required for passing the drifting region.

Alternatively, the autosampler goes without an ion mobility spectrometer.

Advantageously, each one of the plurality of the containers provides an inside with a volume which is in a range from 0.1 l to 10 l, preferably in a range from 0.1 l to 5 l, particular preferably in a range from 0.1 l to 2 l, and most preferably in a range from 0.1 l to 1 l. This has the advantage that the containers provide space for storing most types of sample sources while the autosampler is at the same time not required to be constructed too big. Alternatively, each one of the plurality of the containers provides an inside with a volume which is smaller than 0.1 l or larger than 10 l are possible.

Preferably, the autosampler comprises at least five containers and maximally 500, particular preferably maximally 200, more preferably 100, most preferably 50 containers.

Alternatively however, the autosampler may comprise less than five containers like four, three or two containers or more than 500 containers.

Preferably, at least two containers are identical. Particular preferably, at least five containers are identical. Most preferably, all of the containers are identical.

In an alternative however, the containers differ from each other.

Advantageously, the docking ports of the containers are identical. This means, the docking ports of the containers are constructed the same way. This has the advantage that a length of the resulting sample transfer line is the same for all samples. Thus, mass spectra obtained from different samples originating from different sample sources can more easily be compared.

Alternatively, the docking ports of the containers differ from each other.

Advantageously, the samples are gaseous samples.

In a preferred variant, the samples are liquid samples. In yet another preferred variant, the samples are samples in the form of aerosol particles.

Advantageously, the autosampler comprises a heating unit for heating the sample sources in the containers. In a variant, the heating unit is adapted for heating all containers with their content. Thereby, the heating unit may be adapted to heat all containers together or to heat each container with its content individually and thus to an individual temperature, wherein the individual temperatures of the containers can differ from container to container. In another variant, each container comprises a heating unit. Thus, the content of each container can be heated to an individual temperature. This has the advantage that the individual temperatures within the containers be tuned very subtle.

Alternatively, the autosampler may go without such a heating unit. Such an alternative has the advantage that the autosampler can be constructed simpler.

In an example, the autosampler may also comprise a source of electromagnetic radiation like for example visible light for irradiating the sample sources.

In case the samples are gaseous samples and the autosampler comprises a heating unit, the heating unit is preferably adapted for causing thermal desorption for providing the samples. This has the advantage that the samples can be obtained more efficiently. This is particular advantageous in case the sample sources are liquid sample sources. Thus, in case the sample sources are liquid sample sources while the samples are gaseous samples, the samples may be obtained by thermal desorption supported by heat. In another variant however, the gaseous samples may be obtained by bubbling a gas through the liquid sample sources. This gas may for example be a purging gas. In yet another variant, the gaseous samples may be obtained by irradiating laser light on the sample sources.

Independent of the type of sample, each sample is preferably transferable along sample path from the respective container where the respective sample is stored via the docking port of the respective container and via the connector connected to the docking port of the respective container to the ionisation source. Thus, advantageously, when the connector is connected to the docking port of one of the containers, a sample path is provided from the inside of the respective container via the docking port of the respective container and the connector connected to the respective docking port to the ionisation source for transferring the sample from the respective container to the ionisation source. In a preferred variant, the autosampler provides a sample path heating unit for heating these sample paths. This has the advantage that parts of the samples are less likely to stick to any wall or valve along the respective sample path. Thus, less remains of the samples remain in the sample paths which reduces contamination of later samples passing through the sample paths at a later time. Consequently, this has the advantage that less falsified mass spectra can be obtained.

Alternatively however, the autosampler may go without such a sample path heating unit.

Advantageously, the autosampler comprises a control unit for controlling said autosampler. In this case, the control unit can be one physical unit or may comprise more than one physical units. Such a physical unit may for example be an electronic control device like an electronic controller or a computer. In case the control unit comprises more than one physical unit, the physical units are preferably connected with each other and there is advantageously a hierarchy between the physical units. For example, there may be a first electronic controller for controlling the driving means actuating the movements of the ionisation source. There may be a second electronic controller for controlling the ionisation source. Furthermore, there may be a third electronic controller for controlling the mass analyser. Additionally, there may be a fourth electronic controller for controlling any possibly present heating unit for heating the samples in the containers. And in order to control these electronic controllers, there may be yet another electronic controller or a computer for controlling these electronic controllers.

Advantageously, the control unit is adapted to control driving means for operating the autosampler. Thereby, the driving means comprise all means required for:

a) moving the ionisation source with the connector within the autosampler sequentially to each one of the plurality of the containers for connecting the connector to the docking port of the respective container for collecting the sample from the respective container for ionising at least a part of the sample to ions and obtaining the mass spectra from the ions,
b) connecting the connector to the docking ports of the containers for collecting the samples from the containers, and
c) if required, moving the mass analyser with the ionisation source.

Thus, the driving means includes the above mentioned driving units.

Preferably, the control unit is adapted for repetitively sampling the plurality of the samples. This has the advantage that a temporal evolution of the sample sources can be observed because mass spectra are repeatedly obtained from samples originating from the same sample sources.

Alternatively however, the control unit is not adapted for repetitively sample the plurality of samples.

Preferably, the autosampler comprises a support surface on which the containers are mounted and below which the ionisation source is moveable with the connector within the autosampler sequentially to each one of the plurality of the containers for connecting the connector to the docking port of the respective container for collecting the sample from the respective container for ionising at least a part of the sample to ions and obtaining the mass spectra from the ions. This support surface can for example be formed by a table. This support surface has the advantage that an area where the containers are located and an area where the ionisation source is moveable are separated. Thus, safer operation of the autosampler is enabled.

In case the autosampler comprises a support surface on which the containers are mounted and below which the ionisation source is moveable with the connector within the autosampler sequentially to each one of the plurality of the containers for connecting the connector to the docking port of the respective container for collecting the sample from the respective container for ionising at least a part of the sample to ions and obtaining the mass spectra from the ions, the support surface advantageously provides openings reaching from an upper side of the support surface to a lower side of the support surface, wherein for each docking port, a connecting area of the respective docking port for being connected with the connector is located on the lower side of the support surface. This has the advantage that a particular easy access of the connector to the docking ports is achieved.

In a variant however, the support surface may not comprise such openings. In this case, the docking ports may for example be arranged at an edge of the supporting surface.

As an alternative, the autosampler may go without such a surface.

Preferably, the ionisation source is moveable within the autosampler along an overlapping-free linear path for being moved sequentially to each one of the plurality of the containers for connecting the connector to the docking port of the respective container for collecting the sample from the respective container for ionising at least a part of the sample to ions and obtaining the mass spectra from the ions. Thereby, the overlapping-free linear path means, that if the ionisation source is moved along the entire path from a first end to a second end of the path, the ionisation source never takes the same position twice.

In case the ionisation source is moveable within the autosampler along an overlapping-free linear path for being moved sequentially to each one of the plurality of the containers for connecting the connector to the docking port of the respective container for collecting the sample from the respective container for ionising at least a part of the sample to ions and obtaining the mass spectra from the ions, the connector is preferably moveable relative to the ionisation source along a straight line perpendicular to the overlapping-free linear path. This has the advantage that the connector can be connected to and detached from the docking ports very quickly. Alternatively however, the connector is moveable in a different manner or not moveable at all relative to the ionisation source.

Preferably, the ionisation source is moveable within the autosampler in only two dimensions for being moved sequentially to each one of the plurality of the containers for connecting the connector to the docking port of the respective container for collecting the sample from the respective container for ionising at least a part of the sample to ions and obtaining the mass spectra from the ions.

In this case, the connector is preferably moveable relative to the ionisation source in a third dimension perpendicular to a plane defined by the two dimensions in which the ionisation source is moveable. This has the advantage that the connector can be connected to and detached from the docking ports very quickly. In an alternative, the connector is moveable in a different manner or not moveable at all relative to the ionisation source.

Alternatively, the ionisation source is moveable within the autosampler in three dimensions for being moved sequentially to each one of the plurality of the containers for connecting the connector to the docking port of the respective container for collecting the sample from the respective container for ionising at least a part of the sample to ions and obtaining said mass spectra from said ions. In this case, the connector can be fixed relative to the ionisation source or can be moveable relative to the ionisation source.

Preferably, the containers are made of glass, Teflon or stainless steel. This has the advantage that a degassing of the containers is limited, thus limiting false signal in the obtained mass spectra.

Alternatively, the containers may be made from different materials.

Advantageously, the containers are air tight sealable. This has the advantage that outside gases can be prevented of entering the containers. Consequently, thus false signals in the obtained mass spectra can be reduced.

Alternatively, the containers are not air tight sealable.

Preferably, the containers each comprise a gas inlet allowing inserting a purge gas into the respective container. This has the advantage that the containers can be purged if required. Thereby, the purge gas can for example be air or an inert gas. Preferably, the purge gas is a gas which does not react with the sample.

In a variant, the containers each comprise two or more gas inlets. For example, one gas inlet may be for inserting a purge gas into the respective container, while another one is for inserting reagents or dopants into the respective container.

Alternatively, the containers do not each comprise a gas inlet allowing inserting a purge gas into the respective container.

In case the containers each comprise a gas inlet allowing inserting a purge gas into the respective container, advantageously from each of the containers the respective sample is purgeable to the ionisation source by pressing the purge gas into the respective container when the connector is connected to the docking port of the respective container.

Independent of whether the containers each comprise a gas inlet allowing inserting a purge gas into the respective container, from each of said containers the respective sample is advantageously suckable to the ionisation source by generating a lower pressure at the ionisation source than a pressure within the respective container when the connector is connected to the docking port of the respective container.

In this case, the autosampler advantageously comprises a vacuum pump for providing the lower pressure at the ionisation source than the pressure within the respective container when the connector is connected to the docking port of the respective container.

Independent of whether from each of the containers the respective sample is purgeable to the ionisation source by pressing the purge gas into the respective container when the connector is connected to the docking port of the respective container and/or whether from each of said containers the respective sample is advantageously suckable to the ionisation source by generating a lower pressure at the ionisation source than a pressure within the respective container when the connector is connected to the docking port of the respective container, the advantage is achieved that the samples can efficiently be transferred from the respective container to the ionisation source.

Other advantageous embodiments and combinations of features come out from the detailed description below and the entirety of the claims.

BRIEF DESCRIPTION OF THE DRAWINGS

The drawings used to explain the embodiments show.

In the figures, the same components are given the same reference symbols.

PREFERRED EMBODIMENTS

Figure 1:
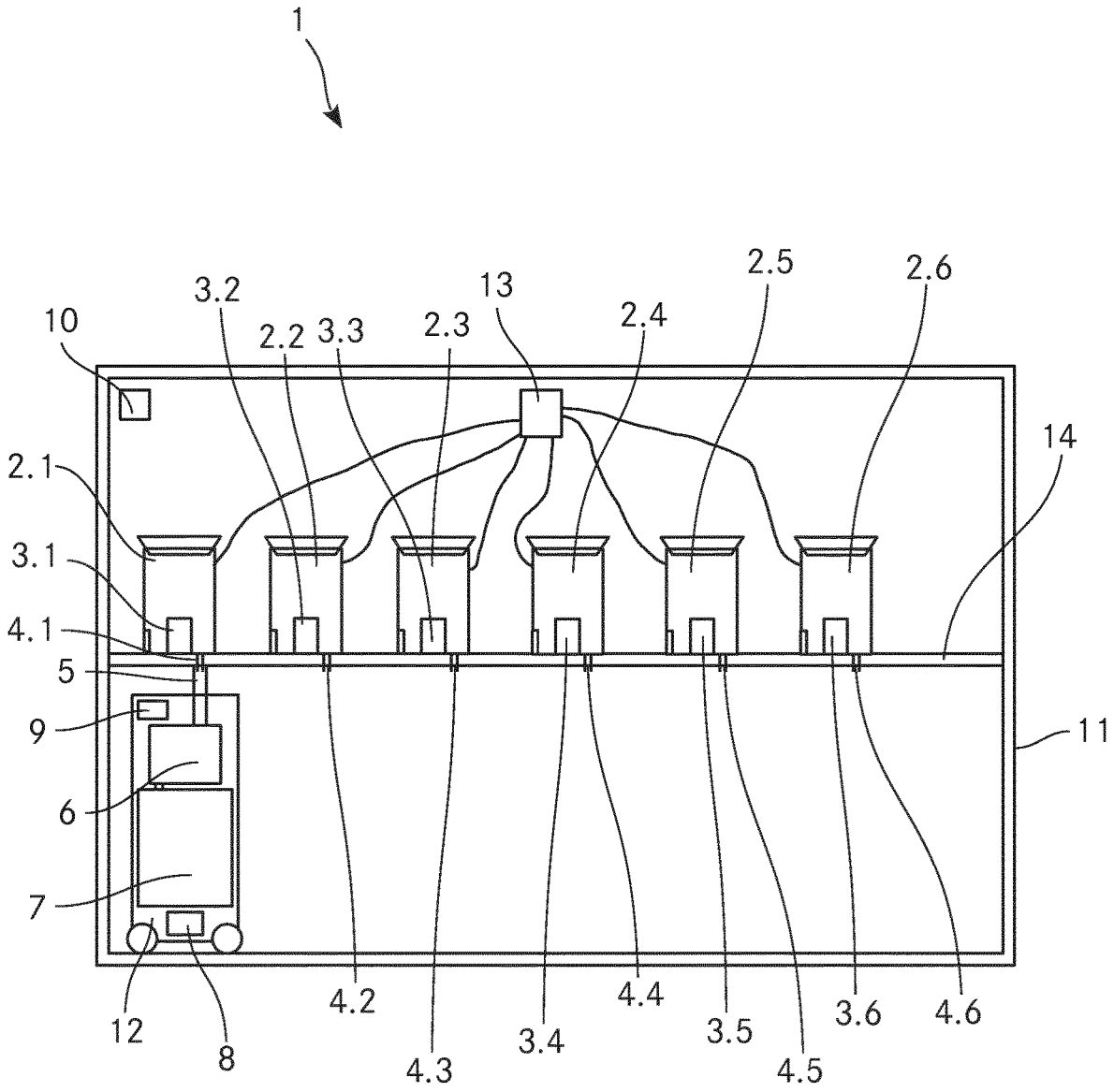
FIG. 1 a simplified schematic side view of an autosampler 1 according to the invention for obtaining mass spectra from a plurality of fluid samples, and FIG. 2 a detail view of FIG. 1.

FIG. 1 shows a simplified schematic side view of an autosampler 1 according to the invention for obtaining mass spectra from a plurality of fluid samples. More precisely, in the present embodiment, the autosampler 1 is for obtaining mass spectra from a plurality of gaseous samples.

The autosampler 1 comprises a plurality of containers 2.1, . . . , 2.6 comprising sample sources 3.1, . . . , 3.6 providing the samples. These containers 2.1, . . . , 2.6 are constructed identically and are thus identical. Each one of the containers 2.1, . . . , 2.6 provides an inside with a volume of 2 l. In a variant, each one of the containers 2.1, . . . , 2.6 provides an inside with a volume different from 2 l. For example, the volume is 0.1 l. In another example, the volume is 0.5 l. In yet another example, the volume is 1 l, 3 l, 5 l or 10 l. Even a volume smaller than 0.1 l or a volume larger than 10 l is possible, too.

In FIG. 1, only six containers 2.1, . . . , 2.6 are shown. This is however due to the simplified schematic view shown in FIG. 1. The autosampler 1 in fact comprises 120 such containers. Nonetheless, this number is not fixed. The autosampler may comprise less containers like for example 100 containers, 50 containers, 10 containers or even exactly 6 containers as shown in FIG. 1 or only 5 containers. Even a larger number of containers like 200 containers or 500 containers or even more containers is possible, too.

The sample sources 3.1, . . . , 3.6 can be plants, microorganisms or objects or liquids. As examples for objects, the sample sources 3.1, . . . , 3.6 can be wood, fabric, plastic elements or anything which degases some gas which is to be analysed with the autosampler 1.

Figure 2:
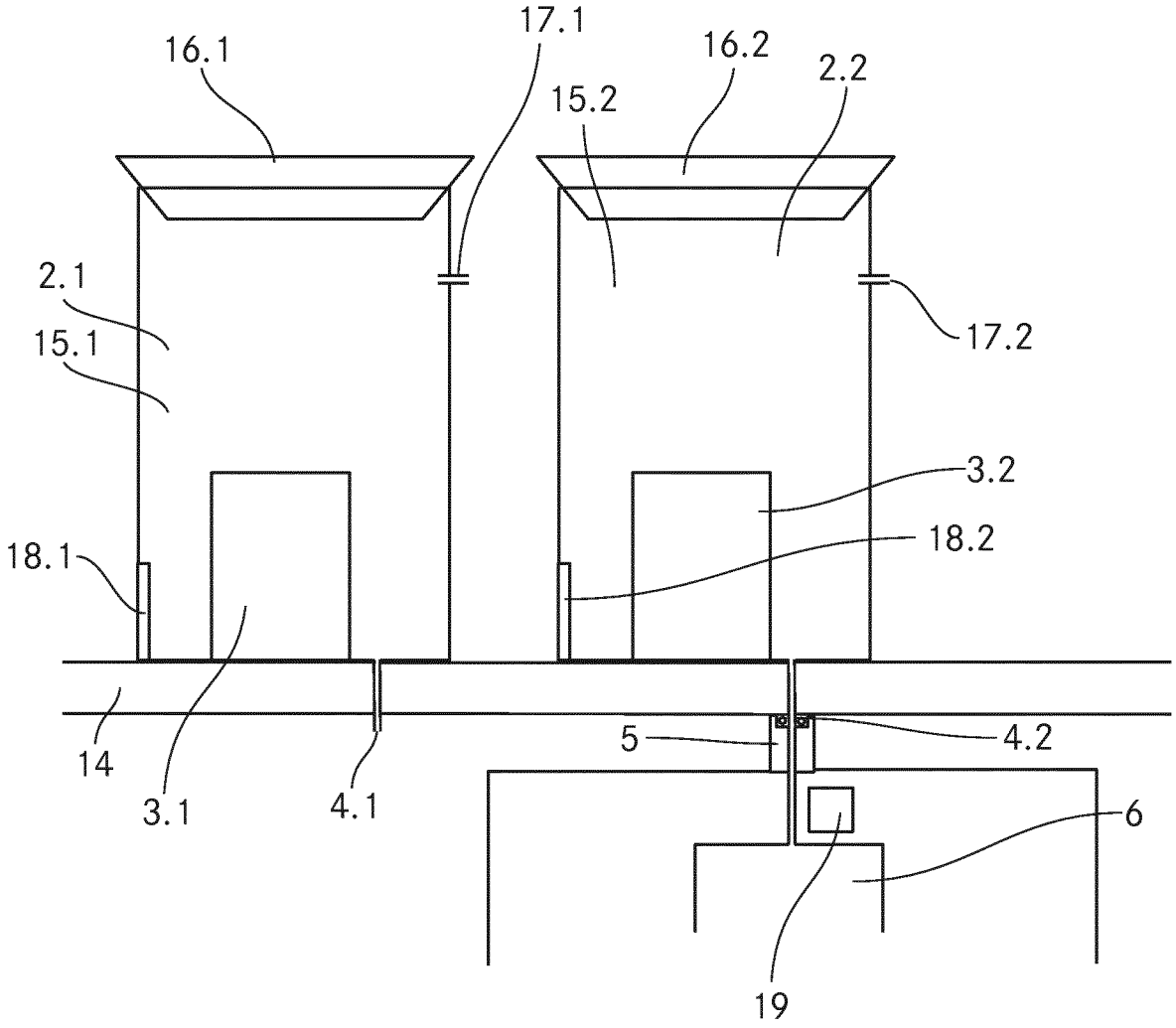

As indicated in FIG. 1 and illustrated in somewhat greater detail in FIG. 2, each one of the containers 2.1, . . . , 2.6 comprises a heating unit 18.1, 18.2. With these heating units 18.1, 18.2, the inside of the containers 2.1, . . . , 2.6 and thus the sample sources 3.1, . . . , 3.6 can be heated. This is particular advantageous in the case of gaseous samples because thermal desorption can be increased such that more sample is obtained from the respective sample source 3.1, . . . , 3.6 per time unit. In a variant to the heating units 18.1, 18.2 comprised by the containers 2.1, . . . , 2.6, the autosampler 1 may comprise one heating unit for heating the containers 2.1, . . . , 2.6 with their contents. In yet another example, the autosampler 1 goes without such one or more heating units 18.1, 18.2.

Each one of the containers 2.1, . . . , 2.6 provides a docking port 4.1, . . . , 4.6 for being connected with a connector 5 for enabling access to an inside of the respective container 2.1, . . . , 2.6 via the connector 5 when the connector 5 is connected to the respective docking port 4.1, . . . , 4.6 in order to obtain the respective sample from the respective container 2.1, . . . , 2.6 via the connector 5. Thus, the connector 5 is connectable to and detachable from each docking port 2.1, . . . , 2.6. Thereby, the connector 5 is connectable to one of the docking ports 2.1, . . . , 2.6 at a time. The docking ports 4.1, . . . , 4.6 of the containers 2.1, . . . , 2.6 are constructed identically and are thus identical.

The autosampler 1 further comprises an ionisation source 6 for ionising at least a part of the samples to ions. This ionisation source 6 is in the present case a proton transfer reaction (PTR) ionisation source. The ionisation source 6 can however be any other ionisation source, too. For example, the ionisation source 6 can be a chemical reaction ionisation source, a plasma ionisation source or even an electrospray ionisation source.

Independent of the type of the ionisation source 6, the ionisation source 6 is fluidly coupled to the connector 5 for receiving the samples from the containers 2.1, . . . , 2.6 via the connector 5. Additionally, the autosampler 1 comprises a mass analyser 7 for obtaining mass spectra from the ions. This mass analyser 7 is in the present case a time-of-flight mass analyser. However, the mass analyser 7 can be any other type of mass analyser like for example a quadrupole mass analyser. Independent of the type of mass analyser, the mass analyser 7 is fluidly coupled to the ionisation source 6 for receiving the ions from the ionisation source 6 for obtaining the mass spectra from the ions. Even though not shown here, the autosampler 1 may comprise an ion mobility spectrometer, too. This ion mobility spectrometer comprises a drifting region for separating the ions passing the drifting region according to their mobility. Furthermore, the ion mobility spectrometer comprises a detector for detecting the ions having passed the drifting region. In one example, this detector is the mass analyser. In this example, the ions from the ionisation source are inserted in a pulsed manner into the drifting region. Thereby, the ionisation source may provide the ions in a pulsed manner or there may be an ion gate between the ionisation source and the drifting region which inserts the ions in a pulsed manner into the drifting region. In this example, the mass analyser receives the ions having passed the drifting region and detects the time when the ions have arrived at the mass analyser for determining ion mobility spectra of the ions.

In another embodiment however, the autosampler 1 goes without ion mobility spectrometer.

Independent of whether the autosampler 1 comprises an ion mobility spectrometer or not, the ionisation source 6 is moveable together with the connector 5 and the mass analyser 7 within the autosampler 1 sequentially to each one of the plurality of said containers 2.1, . . . , 2.6 for connecting the connector 5 to the docking port 4.1, . . . , 4.6 of the respective container 2.1, . . . , 2.6 for collecting the sample from the respective container 2.1, . . . , 2.6 for ionising at least a part of the sample to ions and for obtaining the mass spectra from the ions.

The autosampler 1 furthermore comprises a frame 11. On this frame 11, a support surface 14 is mounted. On this support surface 14, the containers 2.1, . . . , 2.6 are mounted. Below the support surface 14, the ionisation source 6 is moveable with the connector 5 within the autosampler 1 sequentially to each one of the plurality of the containers 2.1, . . . , 2.6 for connecting the connector 5 to the docking port 4.1, . . . , 4.6 of the respective container 2.1, . . . , 2.6 for collecting the sample from the respective container 2.1, . . . , 2.6 for ionising at least a part of the sample to ions and for obtaining the mass spectra from the ions.

Thereby, the support surface 14 provides openings reaching from an upper side of the support surface 14 to a lower side of the support surface 14, wherein for each docking port 4.1, . . . , 4.6, a connecting area of the respective docking port 4.1, . . . , 4.6 for being connected with the connector 5 is located on said lower side of the support surface 14.

The ionisation source 6 and the mass analyser 7 are mounted together in a housing 12. This housing 12 provides wheels and a driving unit 8 in the form of an electric motor for moving the housing 12 with the ionisation source 6 and the mass analyser 7 below the surface 14. In a variant to the electric motor, the driving unit 8 is a pneumatic system. Independent of the type driving unit 8, In one embodiment, the housing 12 is moveable along a straight line which is a linear path. In this embodiment, the ionisation source 6 is moveable within the autosampler 1 along an overlapping-free linear path for being moved sequentially to each one of the plurality of the containers 2.1, . . . , 2.6 for connecting the connector 5 to the docking port 4.1, . . . , 4.6 of the respective container 2.1, . . . , 2.6 for collecting the sample from the respective container 2.1, . . . , 2.6 for ionising at least a part of the sample to ions and for obtaining the mass spectra from the ions. In another embodiment, the housing 12 is moveable in two dimensions in a plane parallel to the support surface 14. In this embodiment, ionisation source 6 is moveable within the autosampler 1 in only two dimensions for being moved sequentially to each one of the plurality of the containers 2.1, . . . , 2.6 for connecting the connector 5 to the docking port 4.1, . . . , 4.6 of the respective container 2.1, . . . , 2.6 for collecting the sample from the respective container 2.1, . . . , 2.6 for ionising at least a part of the sample to ions and for obtaining the mass spectra from the ions.

Independent of whether the housing 12 is only moveable within the autosampler 1 along a straight line, along a linear path or only in two dimensions, the connector 5 reaches from the housing 12 upwards and can be moved upwards and downwards by some driving unit 19 in order to connect the connector 5 to one of the docking ports 4.1, . . . , 4.6 and in order to detach the connector 5 again from the respective docking port 4.1, . . . , 4.6. This driving unit 19 for connecting the connector 5 to one of the docking ports 4.1, . . . , 4.6 and for detaching the connector 5 again from the respective docking port 4.1, . . . , 4.6 can comprise an electric motor, a pneumatic system or the like for actuating the movement of the connector 5.

In another embodiment, the connector 5 is fixed to the housing 12. In this case, the entire housing can be lifted and lowered such that the connector 5 can be moved upwards and downwards together with the housing by some driving unit in order to connect the connector 5 to one of the docking ports 4.1, . . . , 4.6 and in order to detach the connector 5 again from the respective docking port 4.1, . . . , 4.6.

FIG. 2 shows a detail view of FIG. 1. Nonetheless, FIG. 2 still shows a simplified schematic view. It shows two of the containers 2.1, 2.2 mounted on the support surface 14 and an upper part of the housing 12 with the ionisation source 6 and the connector 5 being connected to the docking port 4.2 of one of the two containers 2.2.

In FIG. 2, the docking ports 4.1, 4.2 are each simply the end of a tube. Thereby, the end of the tube may somewhat overshoot the lower side of the support surface 14 as illustrated in FIG. 2. In a variant however, the end of the tube may as well by flush with the lower side of the support surface.

In FIG. 2, one can recognise that the containers 2.1, 2.2 are jars 15.1, 15.2 having a lid 16.1, 16.2. When covered with the lids, 16.1, 16.2, the containers 2.1, 2.2 are air tight sealed. These jars are 15.1, 15.2 made from glass. Instead of glass, they may however as well be made of Teflon, stainless steel or any other suitable material.

From each jar 15.1, 15.2, a small tube reaches through one of the openings in the support surface 14 form the upper side of the support surface 14 to the lower side of the support surface 14. On the lower ends of these tubes, the docking ports 4.1, 4.2 are arranged. In the side wall of each jar 15.1, 15.2, a gas inlet 17.1, 17.2 for inserting a purge gas into the respective jar 15.1, 15.2 is provided. As indicated in FIG. 1, these gas inlets 17.1, 17.2 are each connected to a purge gas source 13. This purge gas source 13 comprises a purge gas. In the present embodiment, this purge gas is nitrogen. However, the purge gas can be any other gas, too. For example, it can be an inert gas.

The purge gas source 13 contains the purge gas under pressure. Thus, in operation of the autosampler 1, there is a continuous purge gas flow from the purge gas source 13 to the containers 2.1, . . . , 2.6 and through the containers 2.1, . . . , 2.6 via the docking ports 4.1, . . . , 4.6 out of the containers 2.1, . . . , 2.6. Thus, with this continuous flow of purge gas, the samples provided by the sample sources 3.1, . . . , 3.6 are purged out of the containers 2.1, . . . , 2.6. Consequently, when the connector 5 is connected to one of the docking ports 4.1, . . . , 4.6, the sample is purged from the respective container 2.1, . . . , 2.6 via the connector 5 to the ionisation source 6.

In order to enhance flow of the samples from their respective container 2.1, . . . , 2.6 via the respective docking port 4.1, . . . , 4.6 and the connector 5 to the ionisation source 6, the autosampler 1 comprises a vacuum pump 9. This vacuum pump 9 is located in the housing 12 and produces a lower pressure in the ionisation source 6 as compared to a pressure in the containers 2.1, . . . , 2.6. Thus, once the connector 5 is connected to one of the docking ports 4.1, . . . , 4.6, respective sample is additionally sucked from the respective container 2.1, . . . , 2.6 to the ionisation source 6.

The autosampler 1 comprises a control unit 10 for controlling the autosampler 1. This control unit 10 controls the flow of the purge gas from the purge gas source 13 to the containers 2.1, . . . , 2.6, the heating units 18.1, 18.2 of the containers, 2.1, . . . , 2.6, the movement of the housing 12 with the ionisation source 6, the mass analyser 7 and the connector 5. Furthermore, the control unit 10 controls the movement of the connector 5 when connecting to one of the docking ports 4.1, . . . , 4.6 as well as when detaching from the connector 5 from one of the docking ports 4.1, . . . , 4.6. Additionally, the control unit 10 controls the ionisation source 6 and the mass analyser 7. The control unit 10 can be of any type. In one example, the control unit 10 is a computer. This computer may be mounted inside the frame 11 or may be located outside of the frame 11.

The control unit 10 is further adapted for repetitively sample the plurality of samples. Thus, the temporal evolution of the sample sources can be observed because mass spectra are repeatedly obtained from samples originating from the same sample sources.

In operation of the autosampler 1, the sample sources 3.1, 3.2, 3.3, 3.4, 3.5, 3.6 providing the samples are kept in the containers 2.1, 2.2, 2.3, 2.4, 2.5, 2.6 and the containers 2.1, 2.2, 2.3, 2.4, 2.5, 2.6 are sequentially sampled. Thus, the housing 12 with ionisation source 6, the mass analyser 7 and the connector 5 are moved within the autosampler 1 sequentially to each one of the plurality of said containers 2.1, 2.2, 2.3, 2.4, 2.5, 2.6, the connector 5 is each time connected to the docking port 4.1, 4.2, 4.3, 4.4, 4.5, 4.6 of the respective container 2.1, 2.2, 2.3, 2.4, 2.5, 2.6, the respective sample is collected from the respective container 2.1, 2.2, 2.3, 2.4, 2.5, 2.6 and transferred via the connector 5 to the ionisation source 6, where at least a part of the respective sample is ionised to ions. Subsequently, the ions are transferred to the mass analyser 7 where the mass spectra are obtained from the ions.

Thereby, after the respective sample is collected from the respective container 2.1, 2.2, 2.3, 2.4, 2.5, 2.6, the connector 5 is detached from the docking port 4.1, 4.2, 4.3, 4.4, 4.5, 4.6 of the respective container 2.1, 2.2, 2.3, 2.4, 2.5, 2.6. Thereby, it is irrelevant whether the connector 5 is detached from the respective container 2.1, 2.2, 2.3, 2.4, 2.5, 2.6 before, during or after the mass spectra of the ions of the respective sample are obtained, as long as the respective sample is collected from the respective container 2.1, 2.2, 2.3, 2.4, 2.5, 2.6 when the connector 5 is detached from the docking port 4.1, 4.2, 4.3, 4.4, 4.5, 4.6 of the respective container 2.1, 2.2, 2.3, 2.4, 2.5, 2.6.

Each time one of the containers 2.1, 2.2, 2.3, 2.4, 2.5, 2.6 is sampled, the respective sample is transferred during a time 5 s from the respective container 2.1, 2.2, 2.3, 2.4, 2.5, 2.6 to the ionisation source 7. In variants of the method for operating the autosampler 1, this time may however be different from 5 s. For example, it may be only 1 s, but it may as well be 30 s, 60 s or even minutes like 30 minutes or more.

After a container 2.1, 2.2, 2.3, 2.4, 2.5, 2.6 is sampled this way, the connector 5 is detached from the docking port 4.1, 4.2, 4.3, 4.4, 4.5, 4.6 of one of the containers 2.1, 2.2, 2.3, 2.4, 2.5, 2.6, the housing 12 with the ionisation source 6, the mass analyser 7 and the connector 5 are moved within the autosampler 1 to the next one of the containers 2.1, 2.2, 2.3, 2.4, 2.5, 2.6 and the connector 5 is connected to this next one of the containers 2.1, 2.2, 2.3, 2.4, 2.5, 2.6 until all containers 2.1, 2.2, 2.3, 2.4, 2.5, 2.6 have been sampled. Each such change from one container 2.1, 2.2, 2.3, 2.4, 2.5, 2.6 to the next container 2.1, 2.2, 2.3, 2.4, 2.5, 2.6 takes a time from 1 s to 30 seconds. Alternatively however, this may take a shorter or a longer time.

When sampling one of the containers 2.1, 2.2, 2.3, 2.4, 2.5, 2.6, mass spectra are obtained repeatedly. Even more, mass spectra are obtained repeatedly as well when none of the containers 2.1, 2.2, 2.3, 2.4, 2.5, 2.6 is sampled. This has the advantage that any leftovers in the system from samples originating from containers 2.1, 2.2, 2.3, 2.4, 2.5, 2.6 previously sampled can be identified which lead to contaminations in mass spectra obtained from containers 2.1, 2.2, 2.3, 2.4, 2.5, 2.6 which are later sampled. In a variant however, mass spectra can be obtained repeatedly only when one of the containers 2.1, 2.2, 2.3, 2.4, 2.5, 2.6 is sampled.

The invention is not limited to the embodiments described above. For example, the autosampler is not required to obtain mass spectra from a plurality of gaseous samples. Instead, the autosampler can be adapted for obtaining mass spectra from a plurality of liquid samples. In this case, the ionisation source is preferably an electrospray ionisation source.

In summary, it is to be noted that an autosampler and a method for operating such an autosampler that enable obtaining more accurate mass spectra of a plurality of fluid samples are provided.

The invention claimed is:

1. An autosampler for obtaining mass spectra from a plurality of fluid samples comprising:

a) a plurality of containers comprising sample sources providing said samples, wherein each one of said containers provides a docking port for being connected with a connector for enabling access to an inside of the respective container via said connector when said connector is connected to the respective docking port in order to obtain the respective sample from the respective container via said connector, wherein said connector is connectable to and detachable from each docking port, b) an ionisation source for ionising at least a part of said samples to ions, wherein said ionisation source is fluidly coupled to said connector for receiving said samples from the containers via said connector, and c) a mass analyser for obtaining said mass spectra from said ions, said mass analyser being fluidly coupled to said ionisation source for receiving said ions from said ionisation source for obtaining said mass spectra from said ions, wherein said ionisation source is moveable with said connector within said autosampler sequentially to each one of said plurality of said containers for connecting said connector to the docking port of the respective container for collecting said sample from the respective container for ionising said at least part of said sample to ions and obtaining said mass spectra from said ions, and wherein said samples are gaseous samples.

2. The autosampler according to claim 1, wherein said mass analyser is moveable together with said ionisation source within said autosampler sequentially to each one of said plurality of said containers for connecting said connector to the docking port of the respective container for collecting said samples from the respective container for ionising said at least part of said samples to ions and for obtaining said mass spectra from said ions.

3. The autosampler according to claim 1, wherein each one of said plurality of said containers provides an inside with a volume which is in a range from 0.1 l to 10 l.

4. The autosampler according to claim 1, wherein said containers are identical.

5. The autosampler according to claim 1, wherein said docking ports of said containers are identical.

6. The autosampler according to claim 1, wherein a control unit for controlling said autosampler.

7. The autosampler according to claim 6, wherein said control unit is adapted for repetitively sampling said plurality of said samples.

8. The autosampler according to claim 1, wherein said autosampler comprises a support surface on which said containers are mounted and below which said ionisation source is moveable with said connector within said autosampler sequentially to each one of said plurality of said containers for connecting said connector to the docking port of the respective container for collecting said sample from the respective container for ionising said at least part of said sample to ions and obtaining said mass spectra from said ions.

9. The autosampler according to claim 8 wherein said support surface provides openings reaching from an upper side of said support surface to a lower side of said support surface, wherein for each docking port, a connecting area of the respective docking port for being connected with said connector is located on said lower side of said support surface.

10. The autosampler according to claim 1, wherein said ionisation source is moveable within said autosampler along an overlapping-free linear path for being moved sequentially to each one of said plurality of said containers for connecting said connector to the docking port of the respective container for collecting said sample from the respective container for ionising said at least part of said sample to ions and obtaining said mass spectra from said ions.

11. The autosampler according to claim 1, wherein said ionisation source is moveable within said autosampler in only two dimensions for being moved sequentially to each one of said plurality of said containers for connecting said connector to the docking port of the respective container for collecting said sample from the respective container for ionising said at least part of said sample to ions and obtaining said mass spectra from said ions.

12. The autosampler according to claim 1, wherein said containers each comprise a gas inlet allowing inserting a purge gas into the respective container.

13. The autosampler according to claim 12, wherein from each of said containers the respective sample is purgeable to said ionisation source by pressing said purge gas into the respective container when said connector is connected to the docking port of the respective container.

14. The autosampler according to claim 1, wherein from each of said containers the respective sample is suckable to said ionisation source by generating a lower pressure at said ionisation source than a pressure within the respective container when said connector is connected to the docking port of the respective container.

15. The autosampler according to claim 1, wherein each one of said plurality of said containers provides an inside with a volume which is in a range from 0.1 l to 5 l.

16. The autosampler according to claim 1, wherein each one of said plurality of said containers provides an inside with a volume which is in a range from 0.1 l to 2 l.

17. The autosampler according to claim 1, wherein each one of said plurality of said containers provides an inside with a volume which is in a range from 0.1 l to 1 l.

18. A method for obtaining mass spectra from a plurality of fluid samples with an autosampler, comprising:

keeping sample sources providing said samples in a plurality of containers, wherein each one of said containers provides a docking port for being connected with a connector for enabling access to an inside of the respective container via said connector when said connector is connected to the respective docking port in order to obtain the respective sample from the respective container via said connector, wherein said connector is connectable to and detachable from each docking port, and sequentially sampling the containers by a) moving an ionisation source and said connector within said autosampler to each desired one of said plurality of said containers, b) connecting said connector to the docking port of the respective container, c) collecting the respective said sample from the respective container, d) transferring the respective said sample via said connector to said ionisation source, e) ionising at least a part of the respective said sample to ions, f) transferring said ions to a mass analyser and g) obtaining said mass spectra from said ions, wherein after the respective said sample is collected from the respective container, said connector is detached from the docking port of the respective container, and wherein said samples are gaseous samples.

* * * * *